US010966549B2

(12) United States Patent
Forrest et al.

(10) Patent No.: US 10,966,549 B2
(45) Date of Patent: Apr. 6, 2021

(54) PLANAR DISPLAY ASSEMBLY

(71) Applicant: LIBERTY HARDWARE MFG. CORP., Winston-Salem, NC (US)

(72) Inventors: Earl David Forrest, Asheboro, NC (US); Norman Dax Allen, Asheboro, NC (US); Jeffrey John Mathison, Chicago, IL (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

(21) Appl. No.: 16/697,356

(22) Filed: Nov. 27, 2019

(65) Prior Publication Data

US 2020/0093289 A1 Mar. 26, 2020

Related U.S. Application Data

(60) Continuation of application No. 15/800,301, filed on Nov. 1, 2017, now Pat. No. 10,517,411, which is a (Continued)

(51) Int. Cl.
*A47G 1/02* (2006.01)
*A47G 1/06* (2006.01)

(52) U.S. Cl.
CPC ..... *A47G 1/02* (2013.01); *A47G 1/06* (2013.01); *A47G 1/0605* (2013.01); *A47G 2001/0677* (2013.01)

(58) Field of Classification Search
CPC ..... A47G 2001/0677; A47G 1/02
See application file for complete search history.

(56) References Cited

U.S. PATENT DOCUMENTS 908,608 A * 1/1909 Pullen ..... A47G 1/06 40/790
1,354,270 A 9/1920 Wood
(Continued)

FOREIGN PATENT DOCUMENTS

BR 1020120143917 A2 6/2014
CN 201589049 U 9/2010
(Continued)

OTHER PUBLICATIONS

About Smart Mirror Glass, Two Way Mirrors Privacy & Security Products, Product Comparison, Dec. 22, 2015, 3 pages.
(Continued)

*Primary Examiner* — Gary C Hoge
(74) *Attorney, Agent, or Firm* — Brooks Kushman P.C.; Lora Graentzdoerffer

(57) ABSTRACT

A planar display assembly is provided with a planar display pane. A frame is provided with a dado sized to receive the planar display pane. A plurality of retainers mounts to the frame about an inner periphery of the frame to retain the planar display pane within the frame. At least one of the plurality of retainers is elastically deformable to deform during installation of the planar display into the frame, and to expand to retain the planar display pane within the frame. A plurality of apertures or a channel may be formed in the frame about the dado. The plurality of retainers may mount to the frame within the plurality of apertures or the channel of the frame to retain the planar display pane within the frame.

7 Claims, 11 Drawing Sheets

Related U.S. Application Data division of application No. 15/016,958, filed on Feb. 5, 2016, now Pat. No. 9,833,086, which is a continuation-in-part of application No. 15/016,704, filed on Feb. 5, 2016, now Pat. No. 9,924,809, which is a continuation-in-part of application No. 15/004,512, filed on Jan. 22, 2016, now Pat. No. 10,159,364.

(60) Provisional application No. 62/243,819, filed on Oct. 20, 2015.

(56) References Cited

U.S. PATENT DOCUMENTS 2,181,874 A * 12/1939 Cross ..... A47G 1/06 40/765
2,469,923 A 5/1949 Jones
2,696,962 A 12/1954 Goss
3,208,876 A * 9/1965 Dodge ..... A47G 1/06 428/142
3,274,721 A 9/1966 Dreyer
3,283,431 A 11/1966 Pearlman
3,471,111 A 10/1969 MacDonald
3,471,112 A 10/1969 MacDonald et al.
3,501,124 A 3/1970 Goss
3,546,802 A * 12/1970 Preston ..... A47G 1/142 40/762
3,853,226 A 12/1974 Hine et al.
3,908,566 A 9/1975 Frazelle et al.
4,027,413 A 6/1977 Moede
4,037,813 A 7/1977 Loui et al.
4,053,132 A 10/1977 Del Pozzo
4,432,523 A 2/1984 Follows
4,557,457 A 12/1985 Cockfield et al.
4,666,117 A 5/1987 Taft
4,732,358 A 3/1988 Hughes et al.
4,819,901 A 4/1989 McDonald
D301,413 S 6/1989 Rosen
4,991,329 A * 2/1991 Wilson ..... A47G 1/06 160/380
5,380,080 A 1/1995 Rubin et al.
D364,055 S 11/1995 Pakla
D365,947 S 1/1996 Howard
5,759,045 A 6/1998 Gabig et al.
5,974,714 A * 11/1999 Jones ..... A47G 1/0605 40/768
6,186,456 B1 2/2001 Marsh
6,286,802 B1 9/2001 Munson et al.
6,572,943 B2 6/2003 Shaffer
6,964,487 B2 11/2005 Olsen et al.
D536,659 S 2/2007 Panasewicz et al.
D543,056 S 5/2007 Chou
7,337,729 B2 3/2008 Briosi
7,967,400 B1 6/2011 Collum
8,468,767 B1 6/2013 McBride
8,495,830 B2 7/2013 Price
D706,064 S 6/2014 Ota et al.
D713,660 S 9/2014 Weatherly
9,027,766 B1 5/2015 Serotta et al.
D758,771 S 6/2016 Austin, III et al.
D763,023 S 8/2016 Austin, III et al.
9,468,314 B2 10/2016 Goodwin et al.
D793,777 S 8/2017 Johnson et al.
D799,862 S 10/2017 Laumerich et al.
10,070,739 B2 9/2018 Austin, III et al.
D834,357 S 11/2018 Massaud
D836,366 S 12/2018 Brenzy et al.
D869,882 S 12/2019 Dunigan
2002/0081409 A1 6/2002 Shaffer
2003/0038222 A1 2/2003 Holmes
2003/0046849 A1* 3/2003 Lin ..... G06F 1/1601 40/792
2004/0074130 A1 4/2004 Chatterjea
2004/0221772 A1 11/2004 Narkis et al.
2005/0028418 A1* 2/2005 Pargman ..... A47G 1/0616 40/717
2005/0109910 A1 5/2005 Vander Berg et al.
2006/0022214 A1 2/2006 Morgan et al.
2007/0069358 A1 3/2007 McAllister et al.
2007/0153375 A1 7/2007 Peterson et al.
2008/0023615 A1 1/2008 Scarcello
2008/0078916 A1 4/2008 Nevers et al.
2008/0216374 A1* 9/2008 Ozmun ..... A47G 1/0605 40/723
2008/0236053 A1 10/2008 Adams et al.
2008/0237434 A1 10/2008 Lin
2008/0251413 A1* 10/2008 Blumenau-Bebry ..... A47G 1/0605 206/562
2009/0294610 A1 12/2009 Paharik et al.
2010/0060807 A1* 3/2010 Green ..... H05K 5/0017 348/836
2010/0140428 A1 6/2010 Vassallo
2010/0229442 A1 9/2010 Snow et al.
2010/0276562 A1 11/2010 Nguyen
2011/0266406 A1 11/2011 Westimayer et al.
2011/0271571 A1 11/2011 Lennard
2012/0030978 A1 2/2012 Miller
2012/0032062 A1 2/2012 Newville
2012/0144708 A1 6/2012 Schwartz
2012/0145847 A1 6/2012 Wang
2012/0222341 A1* 9/2012 Tucker ..... A47G 1/06 40/790
2012/0260549 A1 10/2012 Andrulewich
2012/0306188 A1 12/2012 Chen
2013/0026319 A1 1/2013 Crescenzo
2013/0048812 A1 2/2013 Lozano
2013/0112637 A1 5/2013 Kuhn
2013/0180142 A1 7/2013 Kressin et al.
2013/0256476 A1 10/2013 Ripke
2013/0256487 A1 10/2013 Ko
2013/0269170 A1 10/2013 Goldberg
2013/0321715 A1 12/2013 Millson et al.
2013/0325670 A1 12/2013 Austin, III et al.
2014/0030490 A1 1/2014 Crosby et al.
2014/0231611 A1 8/2014 Svihilik
2014/0263923 A1 9/2014 McKinney
2014/0291460 A1 10/2014 Warncke et al.
2014/0319988 A1 10/2014 Dietz et al.
2015/0071475 A1 3/2015 Hose et al.
2015/0075046 A1* 3/2015 Skinner ..... A47G 1/06 40/790
2015/0208875 A1 7/2015 Austin, III et al.
2015/0269875 A1 9/2015 Corcoran et al.
2015/0272352 A1 10/2015 Chowdhury et al.
2015/0335152 A1 11/2015 Buettner
2015/0335177 A1 11/2015 Goodwin et al.
2015/0371321 A1 12/2015 Chapuis et al.
2016/0007742 A1 1/2016 Yang
2016/0290573 A1 10/2016 Allen et al.

FOREIGN PATENT DOCUMENTS

CN 201764226 U 3/2011
CN 203857240 U 10/2014
CN 204114511 U 1/2015
CN 204141192 U 2/2015
DE 102012100562 A1 7/2013
GB 2508404 A 6/2014
KR 2020110007036 U 7/2011
KR 2020120006811 U 10/2012

OTHER PUBLICATIONS

The Source for Fine Art, "Glass Vs. Acrylic: Demystifying Glazing", Jan. 10, 2015, 4 pages.
Andscot Company, Inc., "Hang-It Brochure", Applicant Admitted Prior Art, 2 pages.
"Hangman® Wall Mounting Hardware", Ace Hardware, Applicant Admitted Prior Art, 3 pages.

(56) References Cited

OTHER PUBLICATIONS

"Decor Wonderland SSM13 Houston Modem Frameless Mirror", Applicant Admitted Prior Art, 6 pages.
"Rectangle Wall Mirror Frameless Beveled 24"x36", Hook Included", Amazon.com, Applicant Admitted Prior Art, 24 pages.

* cited by examiner

PLANAR DISPLAY ASSEMBLY

CROSS-REFERENCE TO RELATED APPLICATIONS

This application is a continuation of U.S. application Ser. No. 15/800,301, filed Nov. 1, 2017, now U.S. Pat. No. 10,517,411 B2; which is a divisional of U.S. application Ser. No. 15/016,958, filed Feb. 5, 2016, now U.S. Pat. No. 9,833,086 B2; which is a continuation-in-part of U.S. application Ser. No. 15/016,704, filed Feb. 5, 2016, now U.S. Pat. No. 9,924,809 B2; which is a continuation-in-part of U.S. application Ser. No. 15/004,512 filed Jan. 22, 2016, now U.S. Pat. No. 10,159,364 B2; of which, in turn, claim the benefit of U.S. provisional application Ser. No. 62/243,819 filed Oct. 20, 2015, the disclosures of which are hereby incorporated in their entirety by reference herein.

TECHNICAL FIELD

Various embodiments relate to planar display assemblies, such a mirror assemblies.

BACKGROUND

Prior art planar display assemblies, such as mirror assemblies, offer preassembled mirror assemblies with or without a frame. Separate frames and mirror panes are also offered, which require a user to assemble the mirror to the frame, often utilizing various tools. Hardware is installed to mount the frame of a framed mirror assembly to an upright support surface. For unframed mirror assemblies, the hardware is installed to the mirror pane.

SUMMARY

According to at least one embodiment, a planar display assembly is provided with a planar display pane. A frame is sized to receive the planar display pane. A plurality of retainers mounts to the frame about an inner periphery of the frame to retain the planar display pane within the frame. At least one of the plurality of retainers is elastically deformable to deform during installation of the planar display into the frame, and to expand to retain the planar display pane within the frame.

According to at least another embodiment, a planar display assembly is provided with a planar display pane. A frame is provided with a dado sized to receive the planar display pane. A channel is formed in the frame about the dado. A plurality of retainers mounts to the frame within the channel of the frame to retain the planar display pane within the frame.

According to yet another embodiment, a retail method for customizable planar display assemblies provides at least one planar display pane. A mounting hardware kit is provided to mount the planar display pane to an upright support surface. A plurality of frames is provided with varying sizes or varying styles. The plurality of frames is each sized to receive the at one planar display pane. Hardware is provided to interchangeably mount one of the plurality of frames to the at least one planar display pane.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Conventional planar display assemblies, such as mirror assemblies, offer preassembled mirror assemblies with or without a frame. Separate frames and mirror panes are also offered, which require a user to assemble the mirror to the frame, often utilizing various tools. Hardware is installed to mount the frame of a framed mirror assembly to an upright support surface. For unframed mirror assemblies, the hardware is installed to the mirror pane. Dedicated hardware and tools are required for assembling and installing each mirror assembly, which requires significant efforts, components and costs to make any changes. Likewise options for various combinations may be limited.

Figure 1:
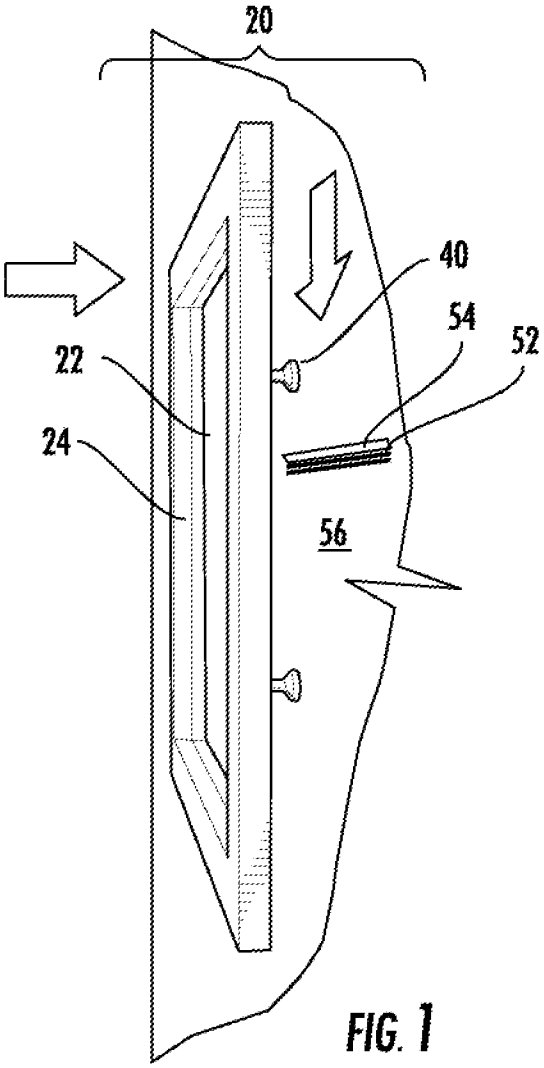
FIG. 1 is a side perspective view of a mirror assembly according to an embodiment, illustrating an installation operation.

Referring now to FIG. 1, a customizable planar display assembly, such as a mirror assembly, is illustrated according to an embodiment, and referenced generally by numeral 20. Although the mirror assembly 20 is illustrated and described, any customizable planar display assembly is contemplated, such as a picture frame. The mirror assembly 20 is customizable in that it includes an interchangeable mirror pane 22 and frame 24.

The mirror assembly 20 provides standardized or common mounting and assembly hardware to offer ease in customer selection, customization, assembly, installations, modifications, replacements, and the like. The mirror pane 22 may be interchangeable with other mirror panes that have a common shape and size, but offer variations in style, such as deluxe glass, which may be clearer, have anti-fog treatment, a beveled perimeter edge, etching, and the like.

When a user desires a framed mirror assembly, a plurality of frames 24 is provided that is each sized to mount to the mirror pane 22. The varying frames 24 are offered in varying colors, finishes, ornamentation, widths, thicknesses and the like.

The mirror assembly 20 includes mounting hardware kits 26 that are common or standardized for mounting any of the mirror panes 22.

Figure 2:
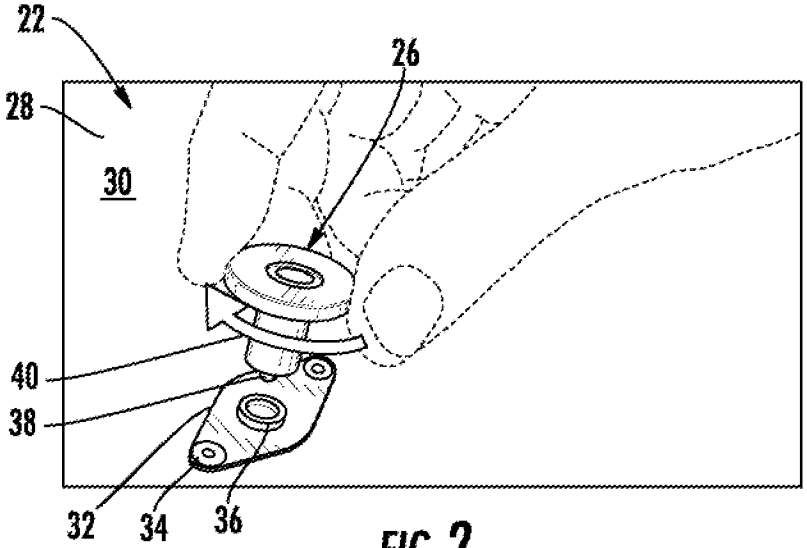
FIG. 2 is a perspective view illustrating an assembly operation of the mirror assembly of FIG. 1.

FIG. 2 illustrates a rear surface 28 of the mirror pane 22. The mirror pane 22 includes a laminated backing board 30 according to an embodiment. A series of mounting plates 32 are fastened to the backing board 30 with rivets 34. The mounting plates 32 include a threaded insert 36 to receive a threaded end 38 of a stud 40 of the mounting hardware kit 26. The studs 40 can be manually installed without requiring additional tools. Studs 40 of various lengths may be provided to offer various mounting distances from the wall, to accommodate various frame thicknesses, to provide a flat appearance against the wall, or to provide a floating appearance away from the wall. The mounting hardware kit 26 and various embodiments thereof, are illustrated and explained in further detail in U.S. application Ser. No. 15/004,512 filed Jan. 22, 2016, now U.S. Pat. No. 10,159,364 B2, the disclosure of which is hereby incorporated in its entirety by reference herein. By providing a common mounting hardware kit 26 for all of the various mirror assembly options, interchangeability, modularity, replacement and reconfiguration are all permitted without additional hardware or tools.

Figure 3:
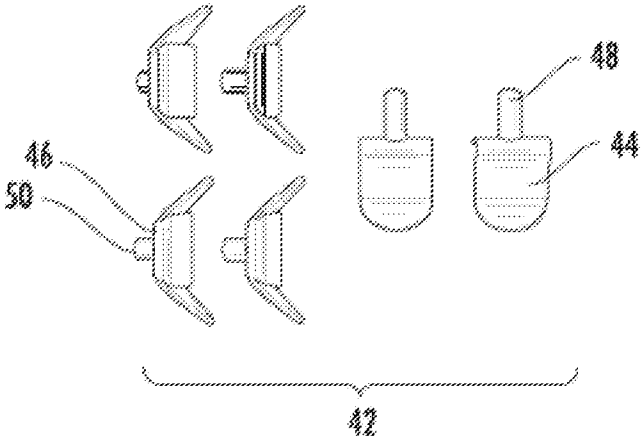
FIG. 3 is a front side elevation view of a frame assembly hardware kit of the mirror assembly of FIG. 1, according to an embodiment.

FIG. 3 illustrates a frame assembly hardware kit 42 according to an embodiment. The frame assembly hardware kit 42 is standardized for all of the frames 24 for commonality, interchangeability, modularity, replacement and reconfiguration of various combinations of frames 24 and mirror panes 22. For convenience, the frame assembly hardware kits 42 may be packaged with each of the frames 24.

The frame assembly hardware kit 42 includes a pair of rigid polymeric retainer clips 44 and a plurality of elastically deformable polymeric locking clips 46. Each of the clips 44, 46 includes a pin 48, 50 for installation into the frame 24.

Figure 4:
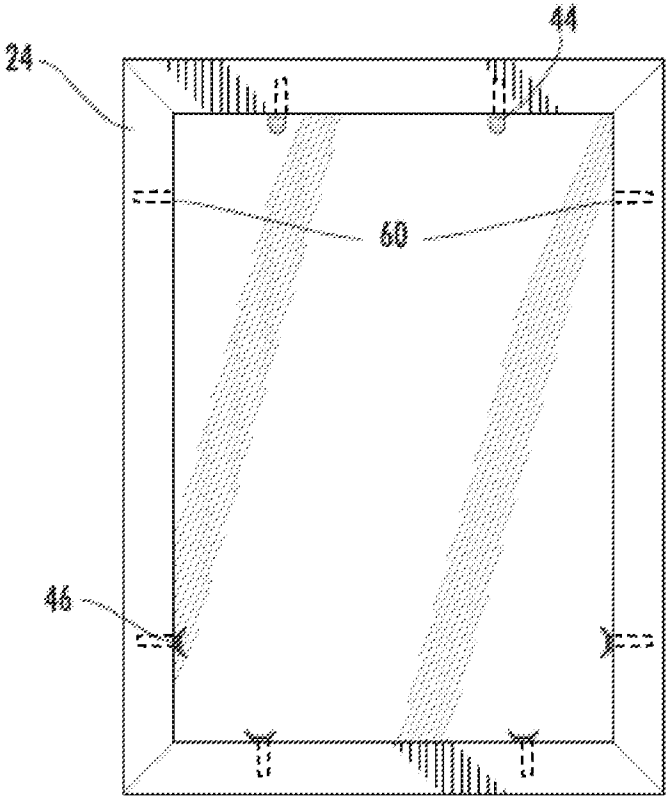
FIG. 4 is a rear side elevation view of a frame and frame assembly hardware kit of the mirror assembly of FIG. 1 in a portrait orientation.
Figure 5:
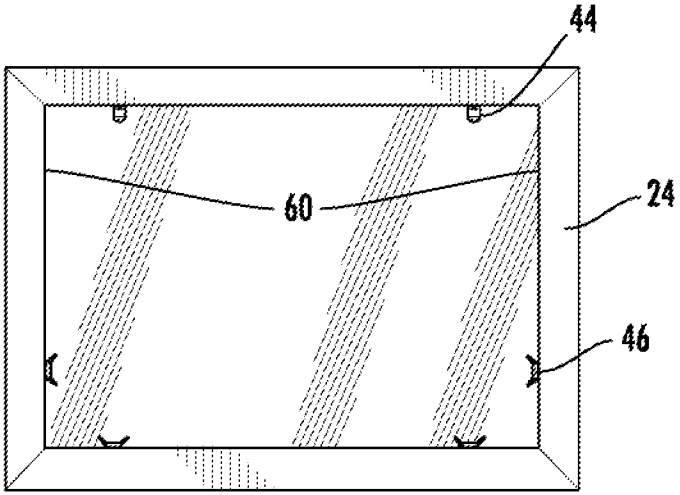
FIG. 5 is a rear side elevation view of a frame and frame assembly hardware kit of the mirror assembly of FIG. 1 in a landscape orientation.

FIGS. 4 and 5 illustrate one of the frames 24 in a portrait orientation (FIG. 4) and a landscape orientation (FIG. 5). The rectangular frame 24 includes a series of apertures 60 about an inner periphery, for example eight apertures, with two formed in each molding member of the frame 24, adjacent an intersection with another molding member, and facing an opposed molding member. The apertures 60 are not viewable in FIGS. 5 and 6, but are identified by the locations of the retainer clips 44 and the locking clips 46. Unused apertures 60 are labeled in FIGS. 4 and 5. Rectangular frames of varying sizes include a similar aperture pattern. For oval frames, a similar aperture pattern is provided with two apertures in each quadrant, one of which faces a vertical direction, and the other faces a horizontal direction.

As illustrated in FIGS. 4 and 5, the retainer clips 44 are installed into the two apertures that are the upper apertures, relative to the intended installation orientation. The locking clips 46 are installed into two lower side apertures and the two apertures that are the lower apertures, relative to the intended installation orientation.

Figure 6:
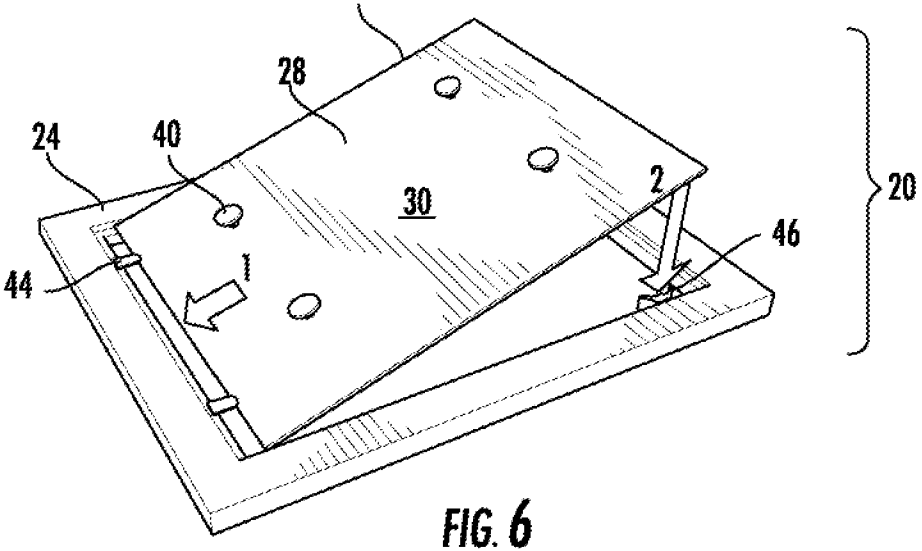
FIG. 6 is a rear perspective view of the mirror assembly of FIG. 1 illustrating another assembly operation.

FIG. 6 illustrates the installation of the mirror pane 22 into the frame 24. The mirror pane 22 is first angled with an upper edge translated beneath the rigid retainer clips 44. Subsequently, the mirror pane 22 is pressed into the frame 24 thereby deforming the locking clips 46 to collapse. Once the mirror pane 22 is properly seated in the frame 24, the locking clips 46 expand to lock the mirror pane 22 into the frame 24.

Referring again to FIG. 1, a bracket 52 with a cleat 54 is installed upon a wall 56. The upper studs 40 of the mirror assembly 20 are received in the cleat 54 to support the mirror pane 22, and consequently, the frame 24 upon the wall 56.

Figure 8:
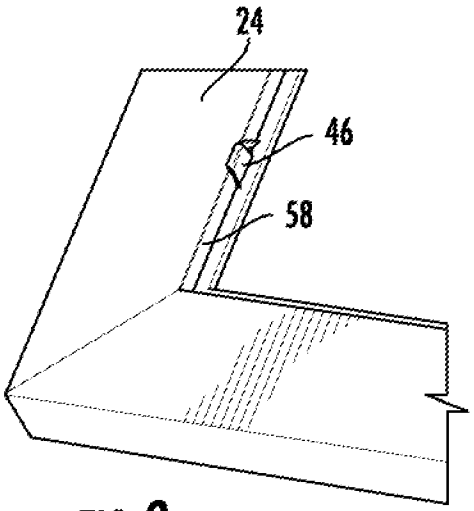
FIG. 8 is an enlarged rear perspective view of another portion of the frame of the mirror assembly of FIG. 1.
Figure 7:
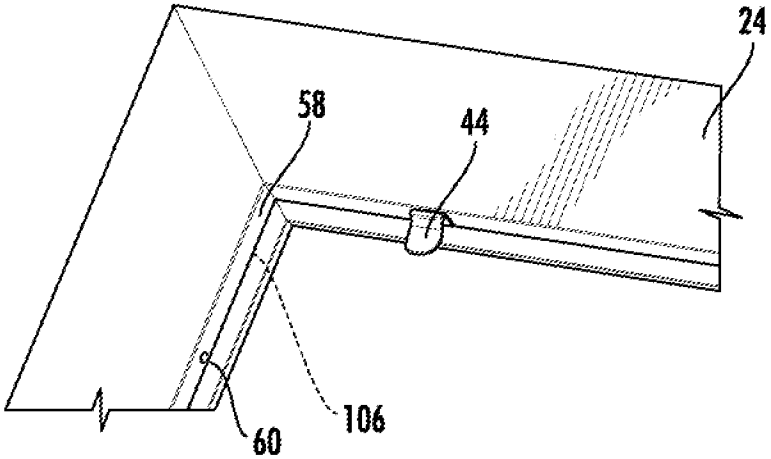
FIG. 7 is an enlarged rear perspective view of a portion of a frame of the mirror assembly of FIG. 1.

FIGS. 7 & 8 illustrate two corners of the frame 24, which are enlarged for greater detail. The corner of the frame 24 in FIG. 7 is an upper corner, as determined by an intended orientation for installation. Likewise, the corner of the frame 24 in FIG. 8 is a lower corner as defined by an intended orientation for installation. The frame 24 is depicted as solid for at least one embodiment. A dado edge 58 is formed in the frame 24 to receive the mirror pane 22. The plurality of apertures (reference numeral 60 in FIG. 7) is formed into the dado edge 58. The apertures 60 may be pre-drilled, or formed by any suitable manufacturing method. The apertures 60 are spaced equidistantly from each corner (or quadrant of a round or oval mirror assembly). The apertures 60 all extend in a direction that is generally parallel with the mirror pane 22. The apertures all face centrally, for example the top and bottom apertures 60 are aligned vertically, and the side apertures 60 are aligned horizontally.

Figure 9:
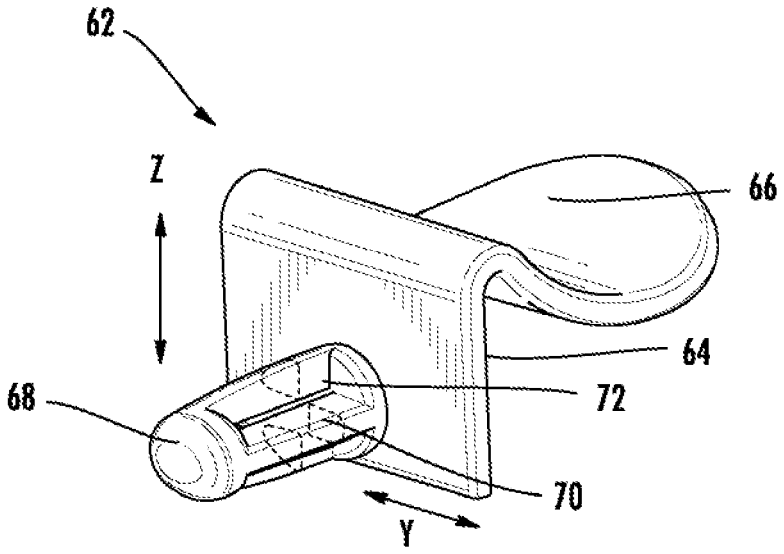
FIG. 9 is a rear perspective view of a retainer of the mirror assembly of FIG. 1, according to an embodiment.

Referring to FIG. 9, a retainer clip 62 is illustrated according to an embodiment. The retainer clip 62 includes a base 64, and a hook 66 extending from the base 64 to engage the mirror pane 22. A pin 68 extends from the base 64. A cross section of the pin 68 is also illustrated in FIG. 9. The pin 68 is enlarged in a Y direction to increase interference with the aperture 60 in the Y direction, which is parallel with the mirror pane 22. A diameter approximately two-thirds from a distal end of the pin 68 is therefore slightly elliptical in shape where the profile is slightly larger in the Y direction when compared to the Z direction. The cross section of the pin 68 is provided by a series of alternating segments 70 with gaps 72 between adjacent segments 70.

Figure 10:
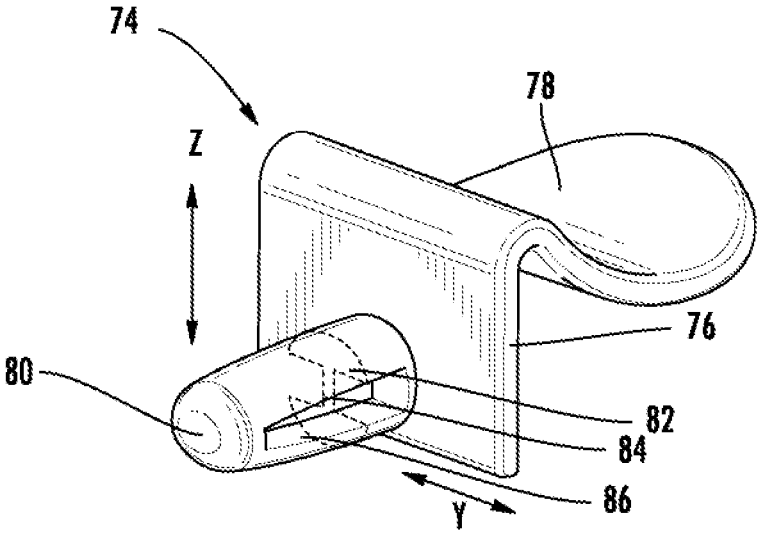
FIG. 10 is a rear perspective view of a retainer of the mirror assembly of FIG. 1, according to another embodiment.

FIG. 10 illustrates another retainer clip 74 according to an embodiment. The retainer clip 74 includes a base 76, a hook 78, and a pin 80. A cross section of the pin 80 is also illustrated in FIG. 10. The pin 80 is enlarged in a Y direction to increase interference with the aperture 60 in the Y direction, which is parallel with the mirror pane 22. The cross section of the pin 80 is provided by a pair of flanges 82 with an intermediate web 84 thereby providing gaps 86.

According to at least one embodiment, the frame 24 is formed from an expanded polystyrene (EPS) material, which by design contain a series of pores within the extrusion which makes the material light in weight. These pores also have a tendency of making thin material sections weaker. These material weaknesses are compensated by the pins 68, 80 enlarged in the Y direction to exert more resistant pressure aligned with the length of the associated member of the frame 24.

Figure 11:
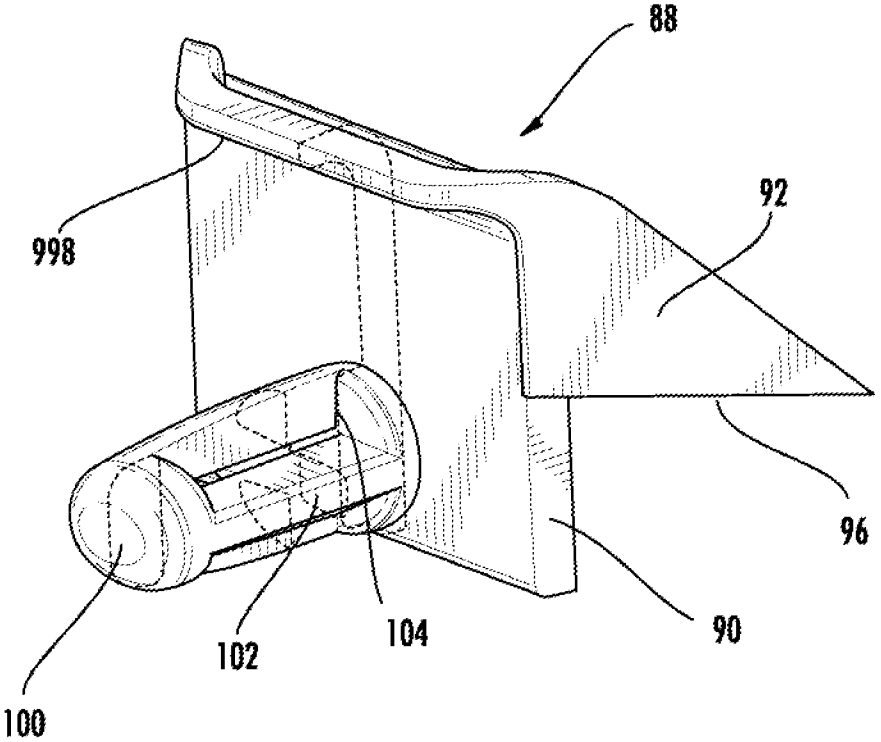
FIG. 11 is a rear perspective view of a retainer of the mirror assembly of FIG. 1, according to another embodiment.
Figure 12:
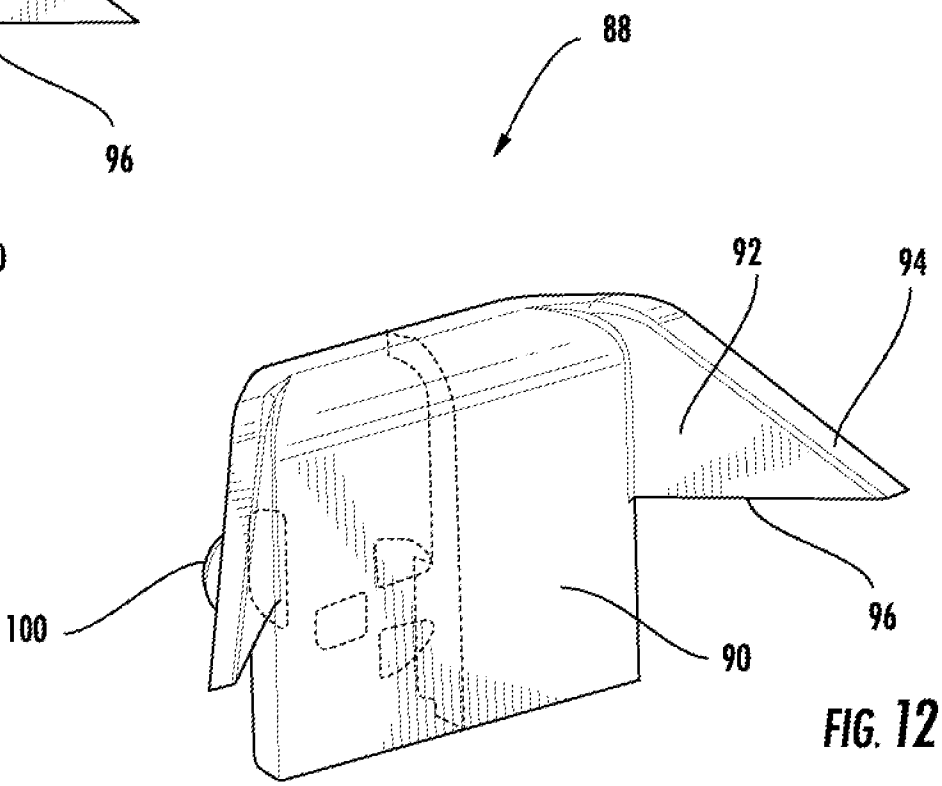
FIG. 12 is a front perspective view of the retainer of FIG. 11.
Figure 13:
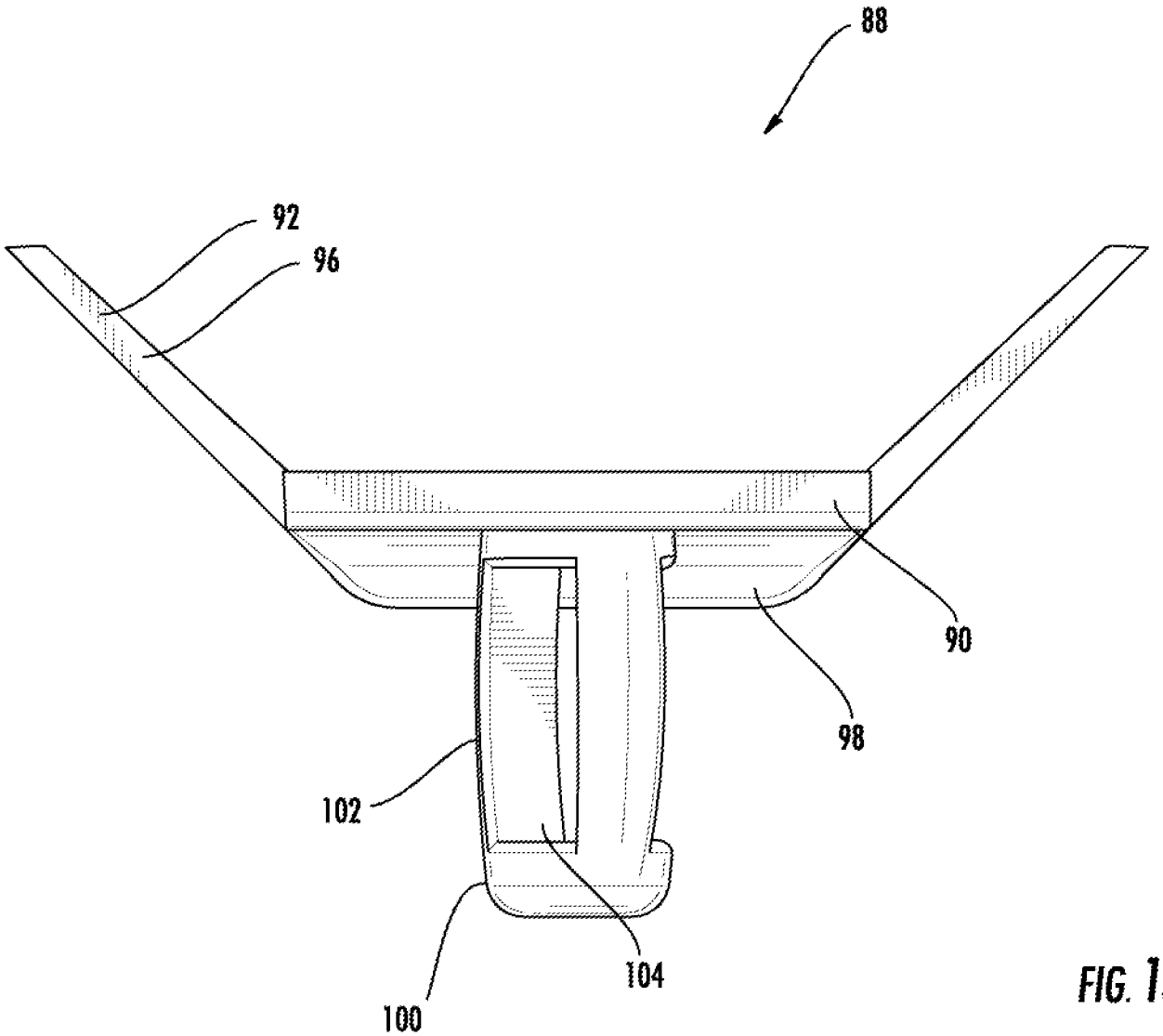
FIG. 13 is a bottom view of the retainer of FIG. 11.

FIGS. 11-13 illustrate a flexible locking clip 88 according to an embodiment. The locking clip 88 includes a base 90 with a pair of flexible tabs 92. Each tab 92 includes an angled leading edge 94 and an abutment edge 96. During installation of the mirror pane 22, the pane 22 contacts the leading edges 94 of the tabs 92, thereby urging the tabs 92 to collapse along the base 90. A lip 98 may extend from the base 90 to engage the frame 24 and minimize rotation of the clip 88 during installation of the mirror pane 22.

Once the mirror pane 22 passes the tabs 92, the tabs expand to an unloaded position such that the abutment edges 96 extend over the mirror pane 22 and lock the mirror pane 22 into the frame 24. The flexible tabs 92 also provide an audible sound or click once expanded to convey to the user that the frame 24 is properly installed upon the mirror pane 22.

The lip 98 projects backward away from the tabs 92. The lip 98 adds support to the base 90, which in turn allows the deformation to occur primarily in the tabs 92 with only minor deformation occurring in the base 90. In addition, the tabs 92 are thicker at the base 90 then at the distal ends, which helps to normalize the bending stress over the entire length of the tab 92. The tabs 92 bend primarily at the tip and become more rigid toward the base 90, which allow the tabs 92 to extend quickly once the mirror pane 22 clears the locking tabs 92.

The locking clip 88 also includes a pin 100 with a cross-section that is oversized in a lateral direction. The pin 100 may be formed from a plurality of segments 102 providing gaps 104 between the segments 102. The pin 100 may be oriented directly behind or in-line with the thickness of the mirror pane 22. In this position, the mirror pane 22 minimizes rotation and provides an integral stop within the assembly 20 and thus prevents the pin 100 from being removed from the aperture 60 as a result of typical forces.

Figure 15:
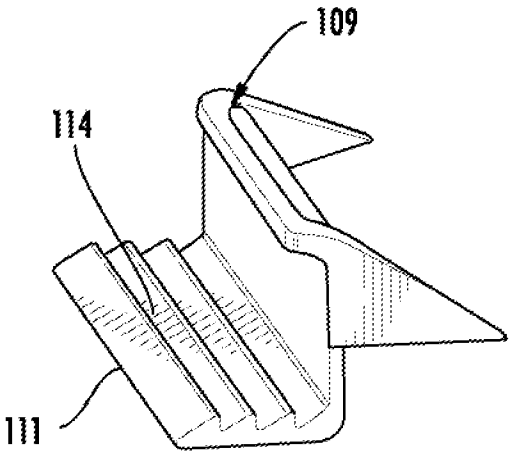
FIG. 15 is a side perspective view of a retainer of the mirror assembly of FIG. 1, according to another embodiment.
Figure 14:
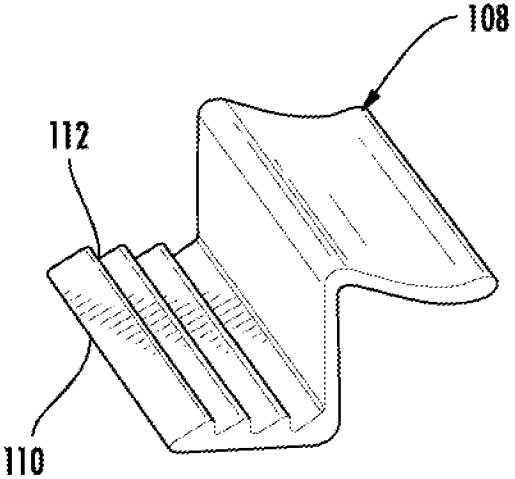
FIG. 14 is a side perspective view of a retainer of the mirror assembly of FIG. 1, according to another embodiment.

Instead of apertures 60, a thin channel 106 may formed in the dado 58 as depicted in FIG. 7. FIGS. 14 and 15 illustrate a retainer clip 108 and a locking clip 109 with flanges 110, 111 respectively. The flanges 110, 111 are each sized to be inserted into the channel 106 and include barbs 112, 114 to fasten the flanges 110, 111 into the channel 106.

Figure 16:
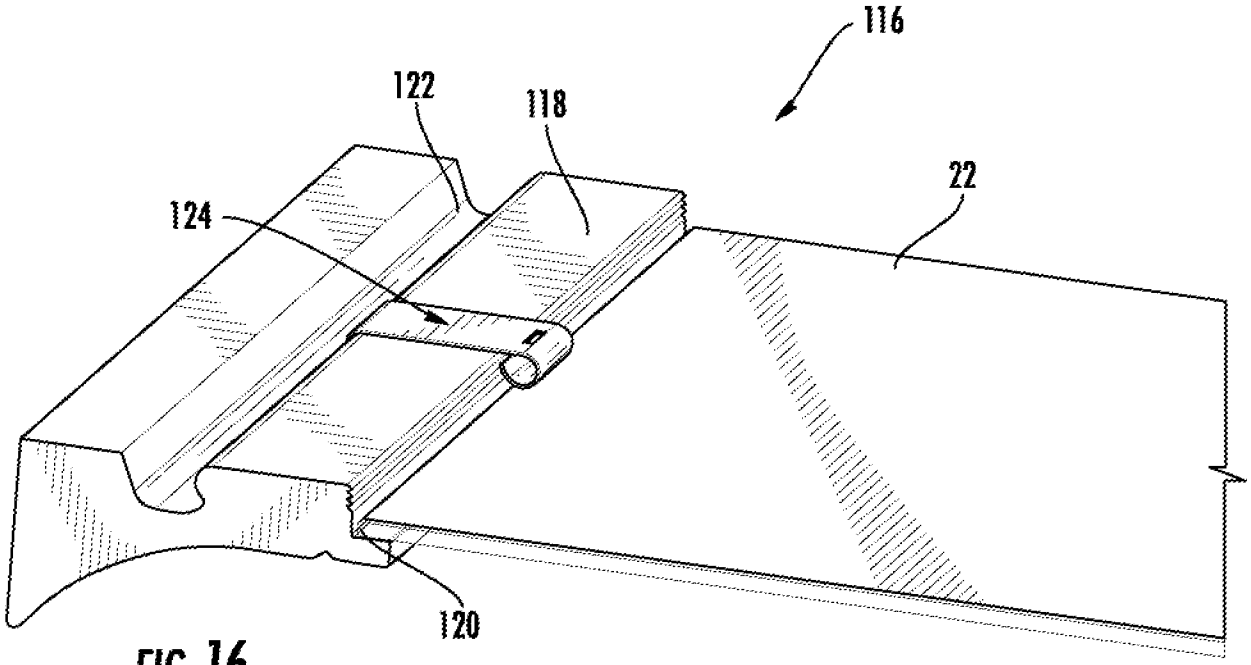
FIG. 16 is a rear fragmentary perspective view of a mirror assembly, according to another embodiment.
Figure 17:
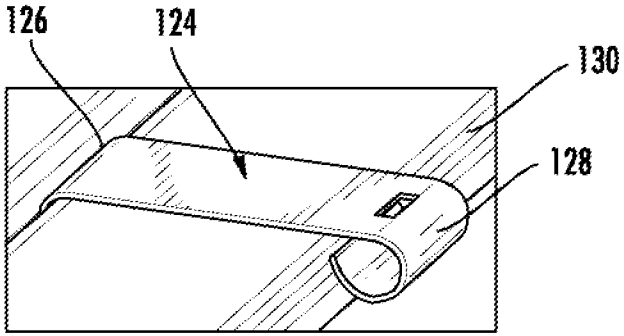
FIG. 17 is an enlarged rear fragmentary perspective view of the mirror assembly of FIG. 16.

FIGS. 16 and 17 illustrate a portion of a mirror assembly 116 according to another embodiment. The mirror assembly 116 includes an extruded frame 118 with a dado 120 to receive the mirror pane 22. A channel 122 is formed into the frame 118 offset from the dado 120. A plurality of retainers 124 is provided which may be formed from a polymeric or metallic material. Each retainer 124 includes a first hook 126 that can be inserted into the channel 122. A second hook 128 is provided to engage the dado 120. The dado 120 includes a plurality of ridges 130. The first hook 126 is inserted into the channel 122 and the second hook 128 is pivoted toward the mirror pane 22. The second hook 128 is elastically deformable to pass some of the ridges 130 to lock into position under compression thereby locking the pane 22 into the frame 118.

Figure 18:
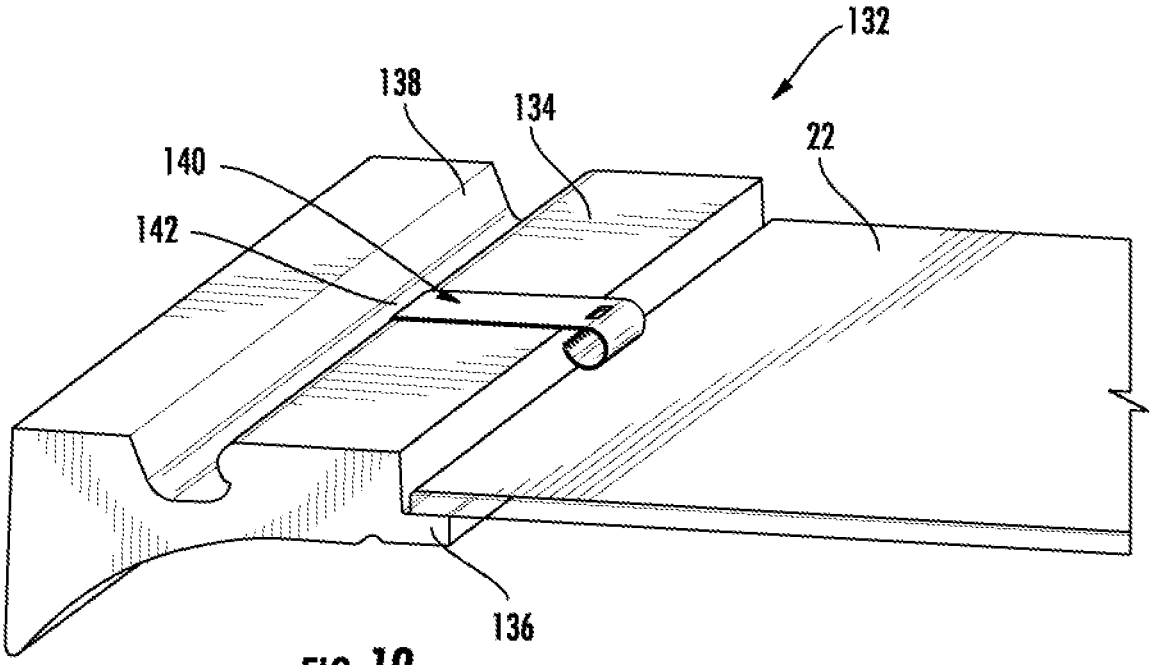
FIG. 18 is a rear fragmentary perspective view of a mirror assembly, according to another embodiment.
Figure 19:
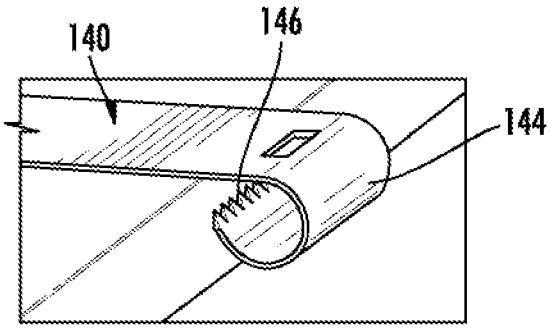
FIG. 19 is an enlarged rear fragmentary perspective view of the mirror assembly of FIG. 18.

FIGS. 18 and 19 illustrate a portion of a mirror assembly 132 according to another embodiment. The mirror assembly 132 includes an extruded frame 134 with a dado 136 to receive the mirror pane 22. A channel 138 is formed into the frame 134 offset from the dado 136. A plurality of retainers 140 is provided which may be formed from a polymeric or metallic material. Each retainer 140 includes a first hook 142 that can be inserted into the channel 138. A second hook 144 is provided to engage the dado 136. The second hook 144 is provided with a series of teeth or projections 146 to engage the dado 136. The first hook 142 is inserted into the channel 138 and the second hook 144 is pivoted toward the mirror pane 22. The second hook 144 is elastically deformable to pass along the dado 136 and to press the teeth 146 into the dado to lock into position under compression thereby locking the pane 22 into the frame 134.

Figure 20:
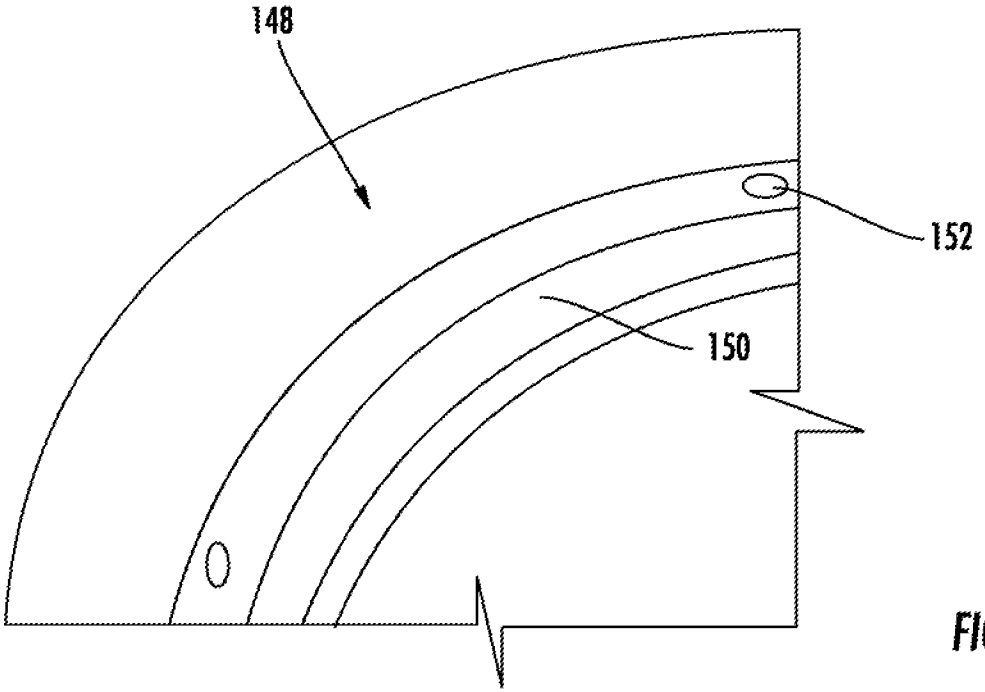
FIG. 20 is an enlarged rear perspective view of a portion of a frame of a mirror assembly according to another embodiment.

FIG. 20 illustrates a portion of an oval frame 148 according to an embodiment. The oval frame 148 includes a dado 150 sized to receive an oval shaped mirror pane. At each quadrant of the oval frame 148, a pair of apertures 152 are provided that are generally perpendicular to each other. One aperture 152 is aligned vertically, and the other aperture 152 is aligned horizontal relative to an intended installation position. This aperture 152 pattern is repeated for each quadrant of the frame to provide eight apertures 152 in the oval frame 148.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A retail method for customizable mirror assemblies comprising:

providing at least one mirror pane;

providing a mounting hardware kit to mount the at least one mirror pane to an upright support surface;

providing a plurality of frames with varying sizes or varying styles, the plurality of frames each sized to receive the at least one mirror pane;

installing elastically deformable hardware to one of the plurality of frames to interchangeably mount the one of the plurality of frames to the at least one mirror pane; and pane;

pressing the one of the plurality of frames to the at least one mirror pane after the elastically deformable hardware is installed, to elastically deform the hardware and to mount the one of the plurality of frames to the at least one mirror pane;

providing the elastically deformable hardware about an inner periphery of the one of the plurality of frames; and inserting an end of the mirror pane into the one of the plurality of frames beneath at least one retainer.

2. The retail method of claim 1 further comprising:

pressing the elastically deformable hardware to elastically deform the elastically deformable hardware; and removing the at least one mirror pane from the one of the plurality of frames.

3. The retail method of claim 2 further comprising:

pressing another of the plurality of frames to the at least one mirror pane to elastically deform the hardware and to mount the another of the plurality of frames to the at least one mirror pane.

4. The retail method of claim 1 further comprising pressing an opposed end of the mirror pane against the elastically deformable hardware to collapse the elastically deformable hardware for clearance of the mirror pane until the mirror pane passes the elastically deformable hardware, to thereby permit the elastically deformable hardware to expand and extend over the mirror pane to retain the mirror pane within the one of the plurality of frames.

5. A retail method for customizable mirror assemblies comprising:

providing at least one mirror pane;

providing a mounting hardware kit to mount the mirror pane to an upright support surface;

providing a plurality of frames with varying sizes or varying styles, the plurality of frames each sized to receive the at least one mirror pane;

installing elastically deformable hardware about an inner periphery of one of the plurality of frames to interchangeably mount the one of the plurality of frames to the at least one mirror pane;

inserting an end of the mirror pane into the one of the plurality of frames beneath at least one retainer in the inner periphery of the one of the plurality of frames; and pressing an opposed end of the mirror pane against the elastically deformable hardware to collapse the elastically deformable hardware for clearance of the mirror pane until the mirror pane passes the elastically deformable hardware, to thereby permit the elastically deformable hardware to expand and extend over the mirror pane to retain the mirror pane within the one of the plurality of frames.

6. The retail method of claim 5 further comprising:

pressing the elastically deformable hardware to elastically deform the elastically deformable hardware; and removing the at least one mirror pane from the one of the plurality of frames.

7. The retail method of claim 6 further comprising pressing another of the plurality of frames to the at least one mirror pane to elastically deform the hardware and to mount the another of the plurality of frames to the at least one mirror pane.

* * * * *